United States Patent [19]

Ravn

[11] Patent Number: 4,809,382

[45] Date of Patent: Mar. 7, 1989

[54] HAND SPRAY WITH A SET OF ROTATING BRUSHES

[75] Inventor: Ole S. Ravn, Rungsted Kyst, Denmark

[73] Assignee: Stig Ravn A/S, Farum, Denmark

[21] Appl. No.: 244,658

[22] Filed: Sep. 14, 1988

Related U.S. Application Data

[63] Continuation of Ser. No. 157,786, Feb. 19, 1988, abandoned.

[30] Foreign Application Priority Data

Sep. 22, 1987 [DK] Denmark ..... 4977/87

[51] Int. Cl.[4] ..... A46B 13/06

[52] U.S. Cl. ..... 15/29

[58] Field of Search ..... 15/24, 28, 29, 97 R; 128/49, 50, 53, 56, 62 A

[56] References Cited

U.S. PATENT DOCUMENTS

| | | | |
|---|---|---|---|
| 2,907,060 | 10/1959 | Laitner | 15/29 |
| 3,906,574 | 9/1975 | Kaeser | 15/29 |
| 4,084,281 | 4/1978 | Smith | 15/29 |

FOREIGN PATENT DOCUMENTS 2433575 1/1976 Fed. Rep. of Germany .

*Primary Examiner*—Edward L. Roberts

*Attorney, Agent, or Firm*—Watson, Cole, Grindle and Watson

[57] ABSTRACT

A hand spray has rotating brushes and consists of a housing with an inlet for the supply of water. In the housing an annular distribution chamber is delimited by means of a cup-shaped inner housing member, within which a turbine wheel is mounted. The turbine wheel is impinged by water flowing from the chamber through nozzles provided in the cup-shaped housing member. The turbine wheel drives the brushes via a gear transmission. In order to obtain a washing effect by means of regular jets simultaneously with the brushing effect of the rotating brushes, a circular array of holes is provided in the part of the housing facing away from the bottom of the cup-shaped housing member, the inner ends of said holes opening into the housing substantially flush with the inner side of the wall of the cup-shaped housing member, the outer ends of the holes opening directly into the open. The brushes of the hand spray are aranged within said circular array of holes.

10 Claims, 4 Drawing Sheets

HAND SPRAY WITH A SET OF ROTATING BRUSHES

This application is a continuation of application Ser. No. 157,786, filed Feb. 19, 1988, now abandoned.

TECHNICAL FIELD OF THE INVENTION.

This invention relates to a hand spray with a set of rotating brushes, said hand spray comprising a housing with an inlet for connection to a water supply, a generally cup-shaped intermediate housing member delimiting an annular distribution chamber within said housing for the distribution of the inflowing water, a turbine wheel rotatably mounted in said intermediate housing member, said turbine wheel being connected via a gear transmission with the set of brushes, said intermediate housing member having nozzle openings for subjecting said turbine wheel to the action of water from said distribution chamber.

BACKGROUND OF THE INVENTION.

A hand spray of this kind is known from the German published application No. 2,433,575. According to this prior art the set of brushes is constituted by an arched disc in which bundles of bristles are arranged, and also water outlet openings are provided. This known hand spray is shiftable between two positions of operation. In one of these, the water from the supply is conducted through the nozzle openings whereby the turbine is driven and in turn drives the brush disc via a planetary gear transmission. In this position the water, after having driven the turbine, is conducted back through the handle of the hand spray to a drain. In the other position of operation, the inflowing water by-passes the turbine and flows through the annular distribution chamber and from there to a cavity provided behind the brush disc, and the water now flows out through the holes provided therein, without the brush disc being driven.

It is a object of the invention to devise a hand spray of the kind referred to, by means of which, simultaneously with the driving of the set of brushes, an efficient washing is produced by the water, after it has driven said turbine wheel. With this object in view, according to the invention, a circular array of holes is provided in the part of the housing remote from the bottom of the cup-shaped housing member, the inner ends of said holes opening into the housing substantially flush with the wall of the cup-shaped housing member, the outer ends of said holes opening directly into the open, the set of brushes being arranged within said circular array of holes. Hereby the advantage is obtained that, simultaneously with the driving of the set of brushes, a plurality of circumferentially distributed jets are produced around the set of brushes, viz. by means of said circular array of holes, and owing to the fact that the inner ends of the holes are flush with the inner side of the wall of the cup-shaped housing member, it has been found that a very uniform distribution of the flow of water through the array of holes is obtained in the form of regular jets so that splashing in the lateral direction is avoided. Thereby a washing is obtained simultaneously with the action of the set of brushes, without any shifting-over of the hand spray being required for that purpose.

Figure 1:
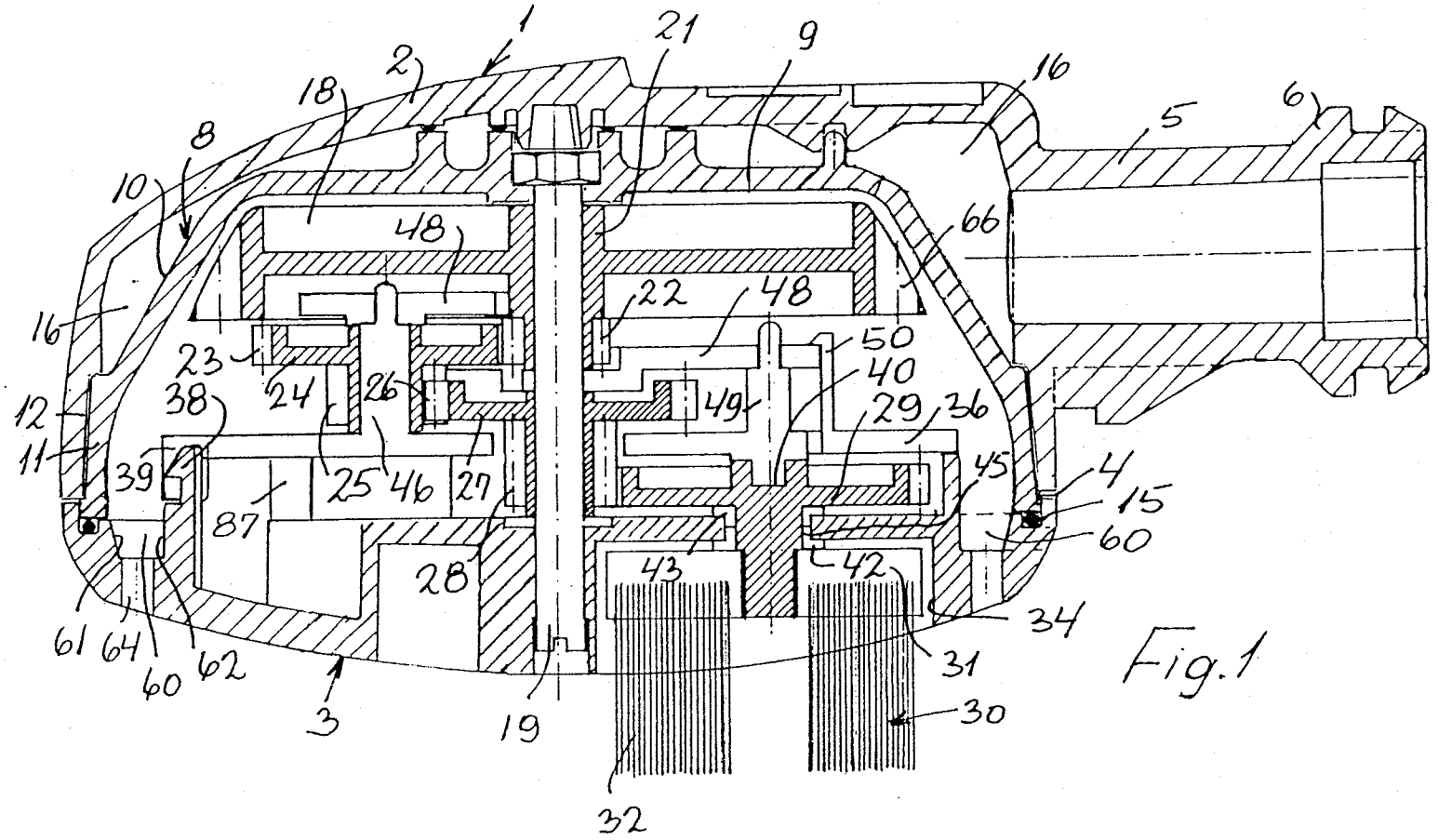
FIG. 1 is a diagrammatic, enlarged vertical section through a hand spray according to one embodiment of the invention.

DESCRIPTION OF THE PREFERRED EMBODIMENT.

In the drawing, 1 is a housing of the hand spray illustrated. This housing consists of a rear part 2 and a front lid part 3. These are in contact with one another along a joint 4.

The rear part 2 is provided with an inlet 5 with a coupling 6 for connection to a water supply via a hose, not shown.

A cup-shaped inner housing member 8 is inserted into the rear part 2 and has a substantially flat end portion 9 and a generally conically widening side portion 10 with a top angle of about 60° integral with a substantially cylindrical side wall portion 11. This is inserted into a corresponding substantially cylindrical side wall portion 12 of the rear housing part 2 in such a manner that the edge of the side wall portion 11 protrudes slightly relatively to the joint 4.

The lid part 3 has a circular circumference, and between this and the protruding edge of the wall portion 11 a packing 15 is inserted in a recess.

The part 2 and the member 8 are so constructed that an annular distribution chamber 16 is formed between these for the distribution of water supplied from the inlet 5.

Figure 4:
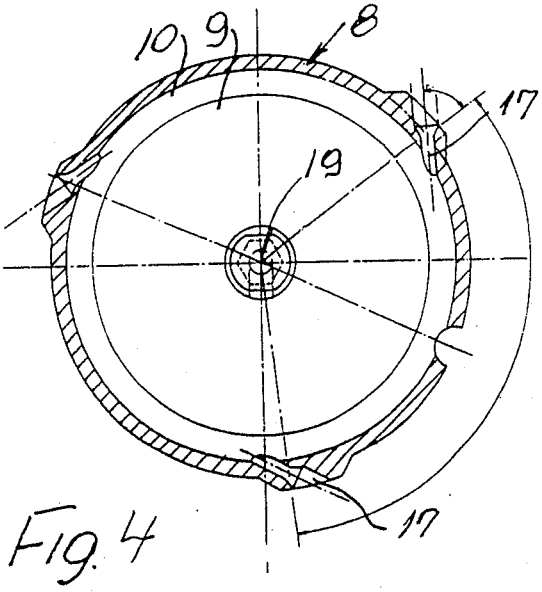
FIG. 4 is a section along the line IV—IV in FIG. 3.

In the side portion 10, three nozzles 17 are provided, which are not visible in FIG. 1, but are shown in FIG. 4. These are uniformly distributed in the circumferential direction and serve to form jets for impinging a turbine wheel 18. These jets are formed as a consequence of the drop of pressure across the nozzles from the distribution chamber 16.

The turbine wheel 18 is rotatably mounted on a screw 19 connecting the rear housing part approximately at its centre with the centre of the lid part 3, and this screw thus keeps the edges at the joint 4 pressed against one another. The turbine wheel is mounted by means of a hub 21, which has an extension formed as a gear wheel 22. This gear wheel 22 meshes with one toothed rim 23 of a first double gear wheel 24, the other toothed rim 25 of which meshes with one toothed rim 26 of a second double gear wheel 27, the other toothed rim of which engages with three gear wheels, of which only one, 29, is shown in the drawing, and each of which is connected with a brush 30.

Each brush consists of a disc 31, to which an annular bundle of bristles 32 is attached.

Figure 2:
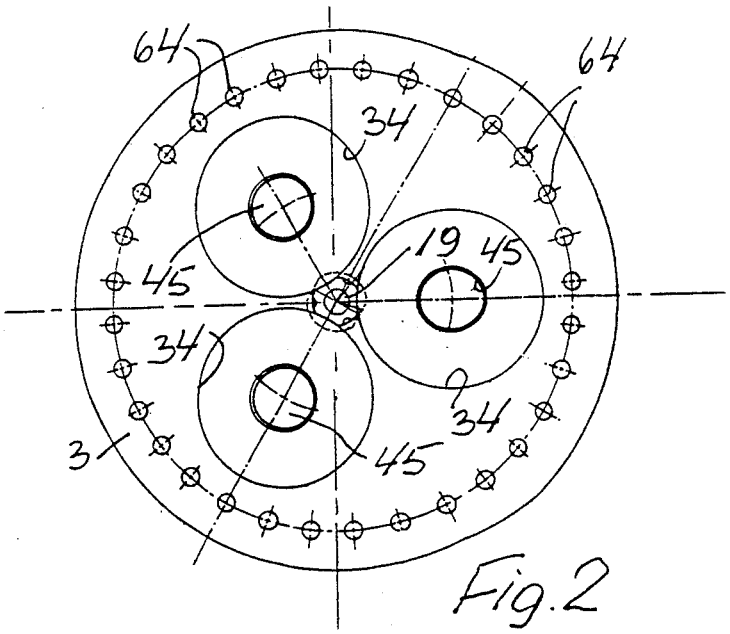
FIG. 2 is a diagrammatic bottom view on a smaller scale of the hand spray shown in FIG. 1.

Each brush is partly received in a cylindrical recess 34 of the lid part 3, the three recesses being shown in FIG. 2, where the brushes 30 are omitted for simplification.

Figure 3:
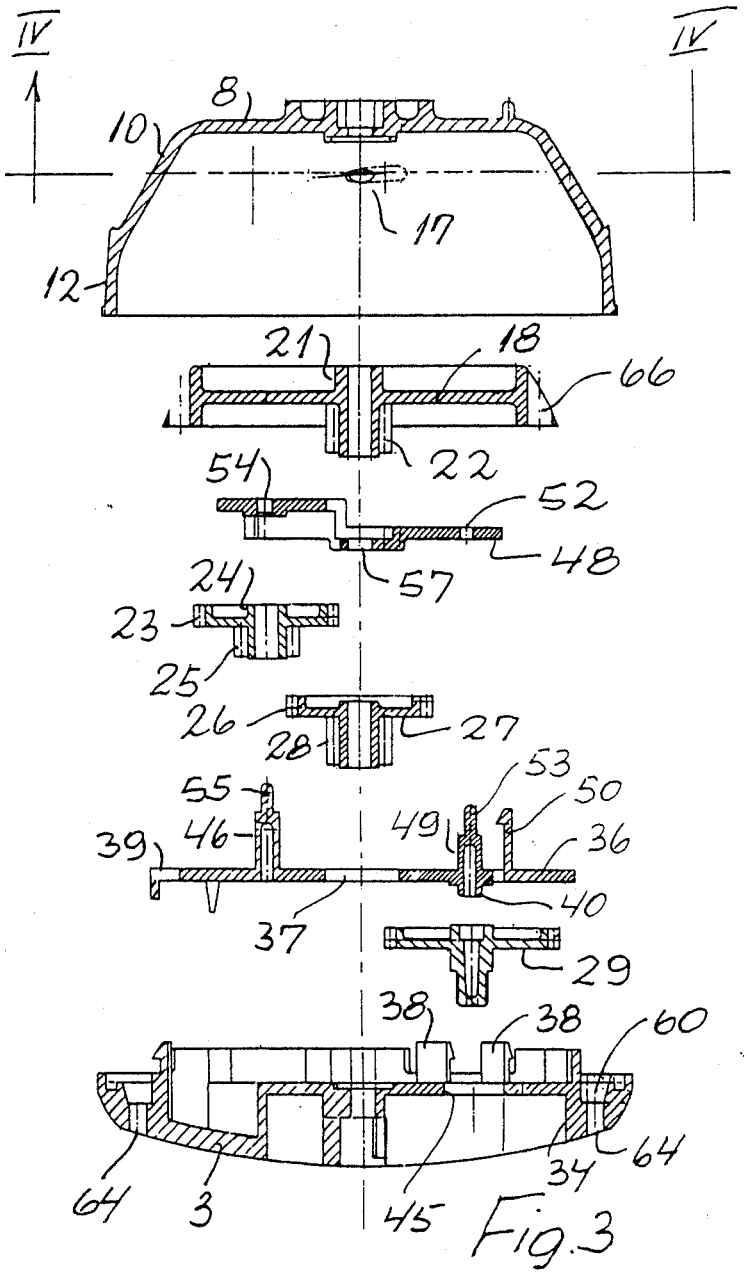
FIG. 3 is an exploded view for illustrating part of the hand spray shown in FIG. 1.

The three brush gear wheels 29 are located in a space between the inner side of the lid part 3 and a first, substantially plateshaped holder 36 (FIG. 3), which has a central hole 37 through which the toothed rim 28 of the gear wheel 27 extends for meshing with the brush gear wheels 29. The holder 36 is supported from the rear side of the lid part 3 by means of supports 87, one of which is shown in FIG. 1. The holder 36 is additionally held in position relatively to the lid part 3 by means of resilient hooks 38, one of which is shown in FIG. 1, and several are shown in FIG. 3. These hooks engage with corresponding openings 39 of the holder 36 (FIG. 3).

On its underside the holder 36 carries three journalling projections 40, viz. one for each brush gear wheel 29, the latter being provided at their upper end with a corresponding journalling recess. The brush gear wheels 29 are moreover rotatably mounted at the bottom of their respective recesses 34 by means of two bearing rings 42, 43, which are inserted into a corresponding hole 45 of the respective recesses.

On its upper side, the holder 36 carries a pin 46 serving as journal of the first double gear wheel 24, the upper end of the pin 46 also serving as a support of a second holder 48. The second holder 48 is additionally supported from the first holder 36 by means of supports 49, one of which is shown in FIGS. 1 and 3. The second holder 48 is additionally held in position by means of hooks 50 carried by the first holder 36 and engaging the edge of the second holder 48.

The second holder 48 has a hole 52 for receiving the upper end 53 of the support 49 and a further hole 54 for receiving the upper end 55 of the pin 46. The second holder 48 has a staggered configuration to make space for the first double gear wheel 24 and is provided at its centre with a hole 57 for the passage of the screw 19. The upper side of the marginal portion of this hole 57 serves as a support for the lower end of the hub 21 of the turbine wheel, and at the same time the gear wheel of the turbine wheel can mesh with the first double gear wheel 24 through an opening 58 of the second holder 48. The underside of the marginal portion of the hole 57 at the same time forms a stop for upward movement of the second double gear wheel 27, which is rotatably mounted on the screw 19, and the lower end of which is supported by the inner side of the lid part 3.

As is apparent from FIG. 1, an annular groove 60 is provided in the inner side of the lid part 3 adjacent its circumference. The groove is outwardly delimited by a conical wall 61 and is inwardly delimited by a cylindrical wall 62. The outer wall 61 extends flush with the inner side of the cylindrical side wall portion 11 of the cup-shaped housing part 8, and the bottom of the groove is pierced by holes 64, which consequently form a circular array of holes, cf. FIG. 2. The axes of the holes extend generally parallel to the axis of the turbine wheel and the diameter of the holes 64 is somewhat smaller than the width of the groove 60 and their length is about 1½ times their diameter. These holes 64 serve for the outflow of water after this has passed the turbine wheel 18, and they are tangentially disposed relatively to the inner portion of the outer wall 61.

Figure 6:
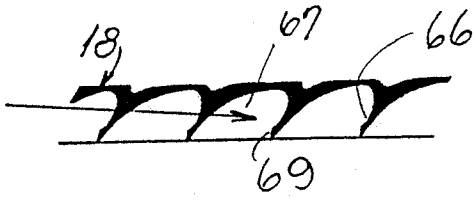
FIG. 6 is a developped partial view of the turbine wheel shown in FIG. 5, as viewed from the side.
Figure 5:
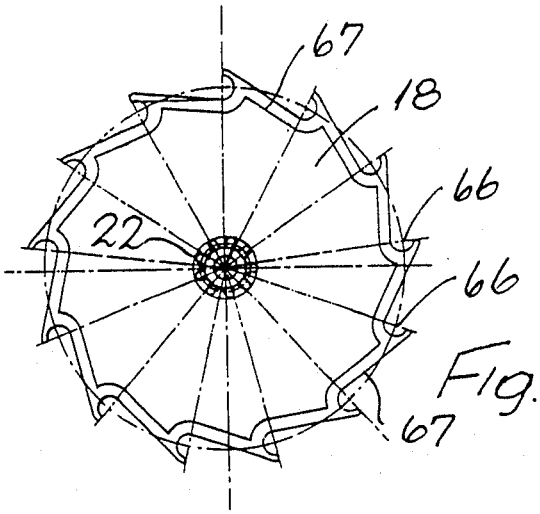
FIG. 5 is a bottom view of a turbine wheel shown in FIG. 3.

The turbine wheel 18 proper is shown more clearly in FIGS. 5 and 6. In FIG. 5, the turbine wheel is, as mentioned, seen from below in FIGS. 1 and 3. At this end, the turbine wheel is "complete", being provided with blade pockets 66, which are inwardly delimited by substantially plane side walls 67 forming an angle of about 5° with a virtual circle extending through the centres of the blade pockets 66. The bottoms of the blade pockets 66 are substantially semi-cylindrical. It is observed that in the embodiment illustrated, thirteen blade pockets and thus also thirteen blades are provided, and that the turbine wheel here considered is driven by three nozzles 17, as previously mentioned. Thus, the number of blades of the turbine wheel is an integral multiple of the number of nozzles, viz. 12, plus 1, or in other words the number of blades is not an integral multiple of the number of nozzles. This relationship has been selected in order to make sure that at any time two nozzles project their jets towards blade pockets. As is clearly apparent from FIG. 1, the turbine wheel 18 has an outer contour which tapers conically upwards at a top angle of 60°, or in other words part of the blades has been omitted as compared to a turbine wheel having a blade profile as shown in FIG. 1 in the whole height of the turbine wheel. From FIG. 5 it is also apparent that the bottoms of the blade pockets extend axially, i.e. parallel to the screw 19. This blade configuration has been specially selected in order to obtain adaptation to the conical side wall portion 10 of the cup-shaped housing member 8. Thus, it is apparent from FIG. 1, that only a small interspace exists between the outer side of the turbine wheel and the inner side of the wall portion 10. This interspace is even shown exaggerated in FIG. 1, seeing that FIG. 1 shows the hand spray on an enlarged scale.

As is apparent from FIG. 4, the axes of the nozzle 17 are inwardly inclined towards the interior of the cup-shaped housing member 18, the axes of the nozzle 17 forming an angle of between 55° and 60°, in the embodiment considered 57,5°, with the radius intersecting the nozzle axis at the outer end of the nozzle. Each nozzle consists of a converging first nozzle portion followed by a cylindrical nozzle portion.

Special reference is made to FIG. 3, where one of the nozzles 17 can be seen in the cup-shaped member 8 there illustrated. From this figure it will be seen that the nozzle in question is inclined from above and downwards, as seen from the outer side of the cup-shaped housing member 8 and towards its inner side. In the embodiment illustrated this angle of inclination amounts to about 3°. It will therefore be realized that the jets flowing out of the nozzles will impinge the turbine wheel 18 at a small downwardly directed speed component.

This direction of the jets is indicated by an arrow in FIG. 6, and from this figure it is also apparent that the blades considered only have their full width at the underside of the turbine wheel, such as indicated at 69.

The hand spray illustrated in the drawings operates in the following manner:

When the water supply through the inlet 5 is switched on, the water will flow into the distribution chamber 16 and from there through the nozzles 17, whereby the turbine wheel will be activated. It has been found in tests that at a water pressure of about 1 bar, a number of revolutions per minute of the turbine wheel of between 2,500 and 3,000 r.p.m. is obtained. This is translated into a rotating movement of the three brushes 30 via the gear wheel 22, the first double gear wheel 24, the second double gear wheel 27 and each of the brush gear wheels 29. By virtue of the high r.p.m. and the very strong gearing-down, a very substantial torque is obtained on each of the brushes 30, in fact to such an extent that it has been found very difficult to prohibit rotation of the brushes 30, even if these are pressed very strongly against e.g. a hand.

Owing to the circumferential distribution of the nozzles and the high speed of the wheel it is assumed that an outward movement of the water takes place after this has acted on the turbine wheel, whereby the water is caused to flow along the inner side of the conical wall 10 of the cup-shaped housing member. From there the water is conducted down into the groove 60 where a tranquilization takes place in such a manner that the edges of each of the holes "peel off" a suitable quantity of water, which flows in such a manner that the water flowing out through the holes 64 forms outwardly directed regular jets which have no tendency to cause splashing in the lateral direction. Thus, simultaneously with the operation of the brushes, a washing effect takes place thanks to the regular outflow through the circular array of holes 64.

I claim:

1. A hand spray with a set of rotating brushes, said hand spray comprising a housing with an inlet for connection to a water supply, a generally cup-shaped intermediate housing member delimiting an annular distribution chamber within said housing for the distribution of the inflowing water, a turbine wheel rotatably mounted in said intermediate housing member, said turbine wheel being connected via a gear transmission with the set of brushes, said intermediate housing member having nozzle openings for subjecting said turbine wheel to the action of water from said distribution chamber, wherein a circular array of holes is provided in the part of the housing remote from the bottom of the cup-shaped housing member, the axes of the holes extending generally parallel to the axis of the turbine wheel, the inner ends of said holes opening into the housing substantially flush with the wall of the cup-shaped housing member and the outer ends of said holes opening directly into the open, the set of brushes being arranged within said circular array of holes.

2. A hand spray as in claim 1, wherein the holes open into the housing in a groove.

3. A hand spray as in claim 1, wherein the holes open into the housing in a groove and the groove is outwardly delimited by a conically widening wall and inwardly delimited by a cylindrical wall.

4. A hand spray as in claim 1, wherein the holes open into the housing in a groove and the groove is outwardly delimited by a conically widening wall and inwardly delimited by a cylindrical wall, and wherein the length of the holes is about 1½ times their diameter, and the holes are tangential to the outer wall.

5. A hand spray as in claim 1, wherein the turbine wheel has a substantially conical outer shape, and the portion of the wall of the cup-shaped housing member within which the turbine wheel is mounted has approximately the same taper as the turbine wheel and surrounds the latter with a small clearance.

6. A hand spray as in claim 1, wherein the turbine wheel has a substantially conical outer shape, and the portion of the wall of the cup-shaped housing member within which the turbine wheel is mounted has approximately the same taper as the turbine wheel and surrounds the latter with a small clearance, and wherein the wall portion and the turbine wheel have a top angle of about 60°.

7. A hand spray as in claim 1, wherein the number of turbine blades is equal to an integral multiple of the number of nozzles plus a number less than the number of nozzles.

8. A hand spray as in claim 1, wherein the nozzles are arranged at an inclination to the circular array of holes, said inclination being about 3°.

9. A hand spray as in claim 1, wherein the blade pockets of the turbine wheel, as seen in the axial direction of the wheel, are of substantially semi-cylindrical shape.

10. A hand spray as in claim 1, wherein the blade pockets of the turbine wheel, as seen in the axial direction of the wheel, are of substantially semi-cylindrical shape, and the blade pockets are inwardly delimited by plane walls.

* * * * *